US012722880B2

(12) United States Patent
Yang et al.

(10) Patent No.: US 12,722,880 B2
(45) Date of Patent: Sep. 1, 2026

(54) UNIT LOAD DEVICE MONITORING SYSTEM

(71) Applicant: Gentex Corporation, Zeeland, MI (US)

(72) Inventors: Yuhang Yang, Holland, MI (US); Michael Burns, Hudsonville, MI (US); Bethany D. Van Houten, Grand Rapids, MI (US); Thomas S. Wright, Holland, MI (US); Andrew D. Weller, Holland, MI (US); David I. Driscoll, Caledonia, MI (US); Xiaoxu Niu, Grand Rapids, MI (US); Bradley R. Hamlin, Allendale, MI (US); Michael F. Behm, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 18/894,439

(22) Filed: Sep. 24, 2024

(65) Prior Publication Data

US 2025/0100794 A1 Mar. 27, 2025

Related U.S. Application Data

(60) Provisional application No. 63/540,144, filed on Sep. 25, 2023.

(51) Int. Cl.
*B65D 90/50* (2019.01)
*B65D 88/14* (2006.01)

(52) U.S. Cl.
CPC ..... *B65D 90/50* (2013.01); *B65D 88/14* (2013.01)

(58) Field of Classification Search
CPC ..... B65D 90/50; B65D 88/14
See application file for complete search history.

(56) References Cited

U.S. PATENT DOCUMENTS 6,047,588 A * 4/2000 Danilychev ..... G01N 1/22 206/524.8
10,282,957 B1 * 5/2019 Kirkbride ..... G01J 5/0066
2012/0048852 A1 * 3/2012 Knote ..... A62C 31/00 220/88.1
2012/0280011 A1 * 11/2012 Duser ..... B64D 11/04 224/401

(Continued)

FOREIGN PATENT DOCUMENTS

DE 60307431 T2 * 11/2006 ..... B60C 23/061
DE 102016221422 A1 * 5/2018 ..... G06Q 10/08

(Continued)

*Primary Examiner* — Rufus C Point
(74) *Attorney, Agent, or Firm* — Price Heneveld LLP; Brian James Brewer

(57) ABSTRACT

A storage system for a plane fuselage including at least one storage unit defining an enclosed cargo storage space. At least one monitoring module is disposed proximate the at least one storage unit. The at least one monitoring module is configured to detect a condition within or proximate the at least one storage unit that includes at least one of a temperature, a fire condition, a water leakage, a gas leakage, a chemical leakage, an explosive condition, or a movement of the at least one storage unit. At least one status communication device is in communication with the at least one monitoring module and is configured to alert a user of the detected condition by the at least one monitoring module.

14 Claims, 6 Drawing Sheets

(56) References Cited

U.S. PATENT DOCUMENTS

| | | | | |
|---|---|---|---|---|
| 2013/0319020 | A1* | 12/2013 | Neeld | F25B 49/02 62/126 |
| 2014/0158382 | A1* | 6/2014 | Ferguson | A62C 37/04 169/61 |
| 2020/0247317 | A1* | 8/2020 | Helm | B60R 9/055 |
| 2021/0303904 | A1* | 9/2021 | Barish | G06T 7/337 |
| 2022/0289384 | A1* | 9/2022 | Lee | B65D 88/14 |

FOREIGN PATENT DOCUMENTS

| | | | | |
|---|---|---|---|---|
| WO | WO-2010149670 | A1 * | 12/2010 | B65D 90/48 |
| WO | WO-2022072736 | A1 * | 4/2022 | G08B 13/06 |
| WO | WO-2022136134 | A1 * | 6/2022 | H04Q 9/00 |

* cited by examiner

UNIT LOAD DEVICE MONITORING SYSTEM

CROSS-REFERENCE TO RELATED APPLICATION

This application claims priority to and the benefit under 35 U.S.C. § 119(e) of U.S. Provisional Application No. 63/540,144, filed on Sep. 25, 2023, entitled "UNIT LOAD DEVICE MONITORING SYSTEM," the disclosure of which is hereby incorporated herein by reference in its entirety.

FIELD OF THE DISCLOSURE

The present disclosure generally relates to a storage system for a plane fuselage and, more particularly, a storage system containing a storage unit and a monitoring module that is configured to detect a condition within or proximate the storage unit.

SUMMARY OF THE DISCLOSURE

According to one aspect of the present disclosure, a storage system for a plane fuselage includes at least one storage unit defining an enclosed cargo storage space. At least one monitoring module is disposed proximate the at least one storage unit. The at least one monitoring module is configured to detect a condition within or proximate the at least one storage unit that includes at least one of a temperature, a fire condition, a water leakage, a gas leakage, a chemical leakage, an explosive condition, or a movement of the at least one storage unit. At least one status communication device is in communication with the at least one monitoring module and is configured to alert a user of the detected condition by the at least one monitoring module.

According to another aspect of the present disclosure, a storage system for monitoring a plurality of storage units in a plane fuselage includes at least one monitoring module. The at least one storage module is configured to be disposed proximate the plurality of storage units. The at least one monitoring module is further configured to detect a condition in at least one of the plurality of storage units that includes at least two of a temperature, a fire condition, a water leakage, a gas leakage, a chemical leakage, or an explosive condition. At least one status communication device is in communication with the at least one monitoring module. The status communication device is configured to alert a user of the detected condition by the at least one monitoring module.

According to yet another aspect of the present disclosure, a storage system for a plane fuselage includes a plurality of monitoring modules configured to be assigned to a plurality of storage units based on contents in the plurality of storage units. The plurality of monitoring modules are configured to detect a condition that includes at least one of a temperature, a fire condition, a water leakage, a gas leakage, a chemical leakage, an explosive condition, or a movement. At least one status communication device is in communication with the plurality of monitoring modules and is configured to alert a user of the detected condition by the plurality of monitoring modules via an overview image that designates which of the plurality of storage units is associated with the detected condition.

These and other features, advantages, and objects of the present disclosure will be further understood and appreciated by those skilled in the art by reference to the following specification, claims, and appended drawings.

DETAILED DESCRIPTION

Figure 1:
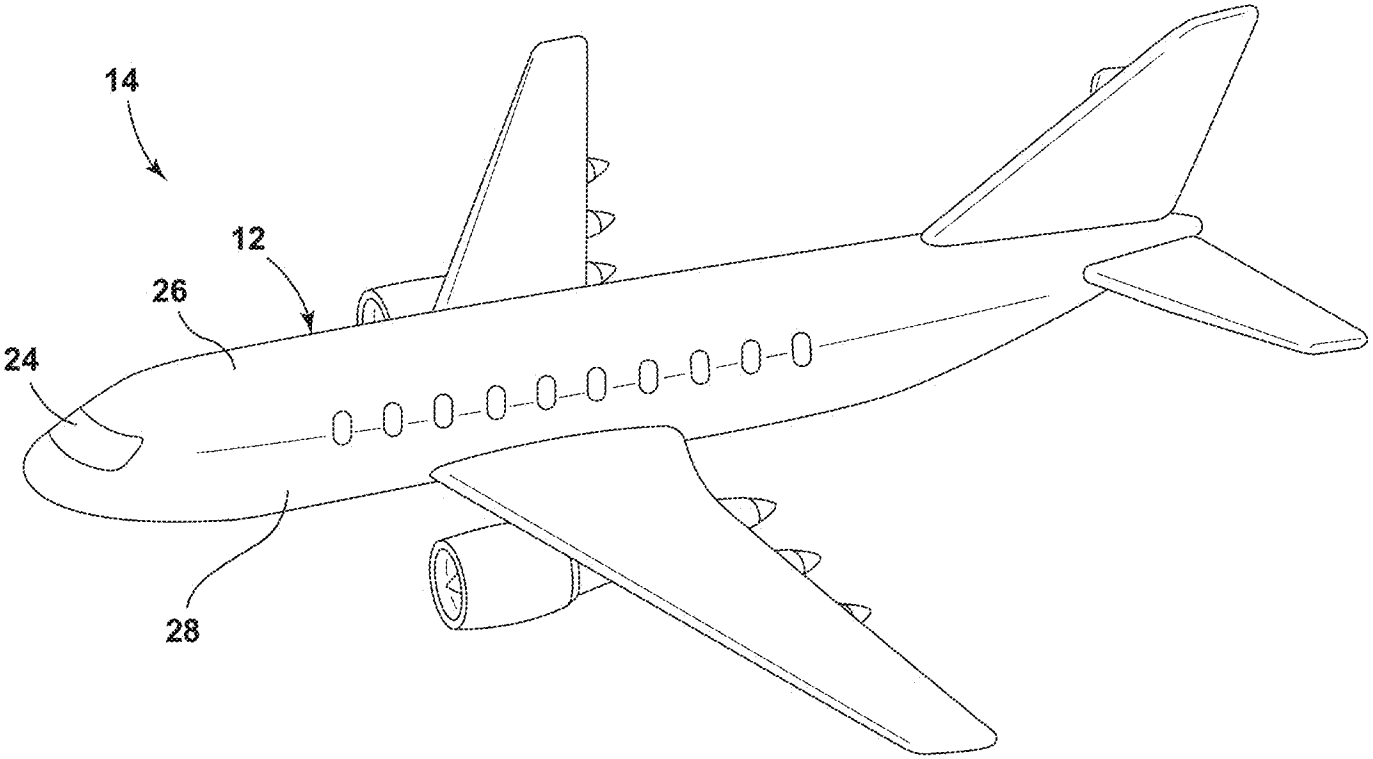
FIG. 1 is a side perspective view of a plane that incorporates a storage system, according to one aspect of the present disclosure.

The present illustrated embodiments reside primarily in combinations of method steps and apparatus components related to a storage system for a plane fuselage containing a storage unit and a monitoring module that is configured to detect a condition within or proximate the storage unit. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof, shall relate to the disclosure as oriented in FIG. 1. Unless stated otherwise, the term "front" shall refer to the surface of the device closer to an intended viewer of the device, and the term "rear" shall refer to the surface of the device further from the intended viewer of the device. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 3:
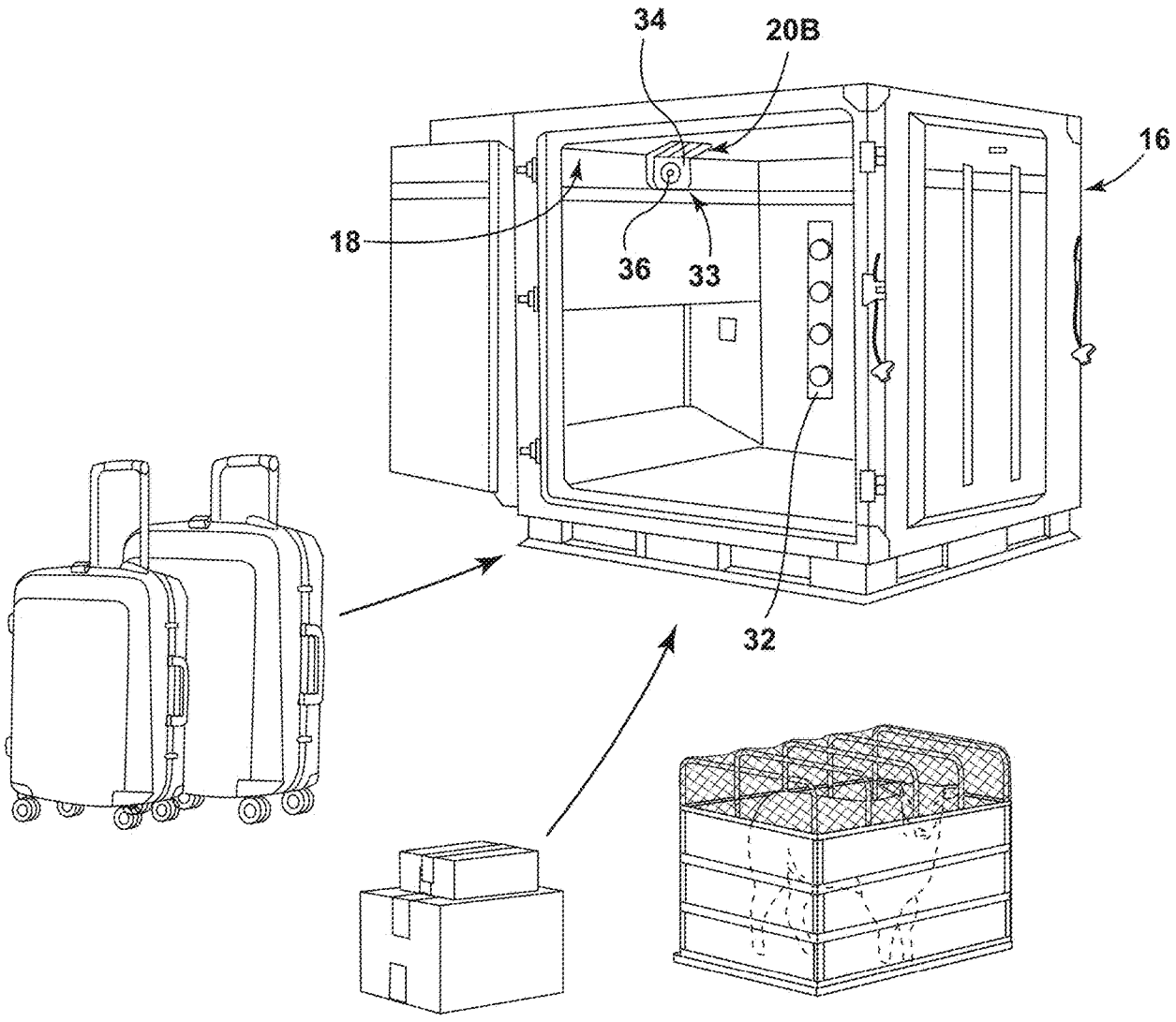
FIG. 3 is a side perspective view of an open storage unit including a monitoring module and cargo being loaded into the storage unit, according to one aspect of the present disclosure.
Figure 4:
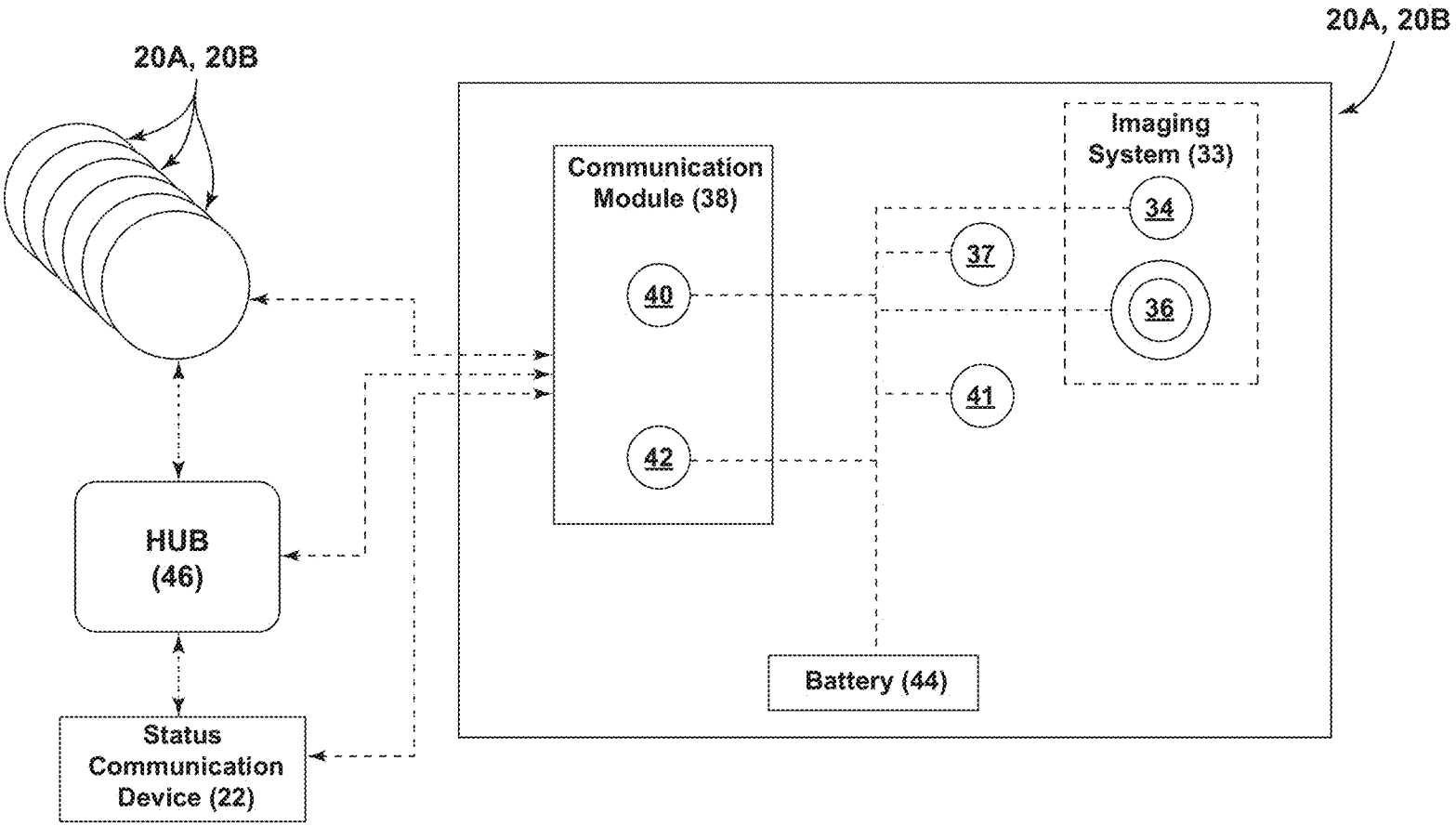
FIG. 4 is a schematic view of a monitoring module, according to one aspect of the present disclosure.
Figure 5:
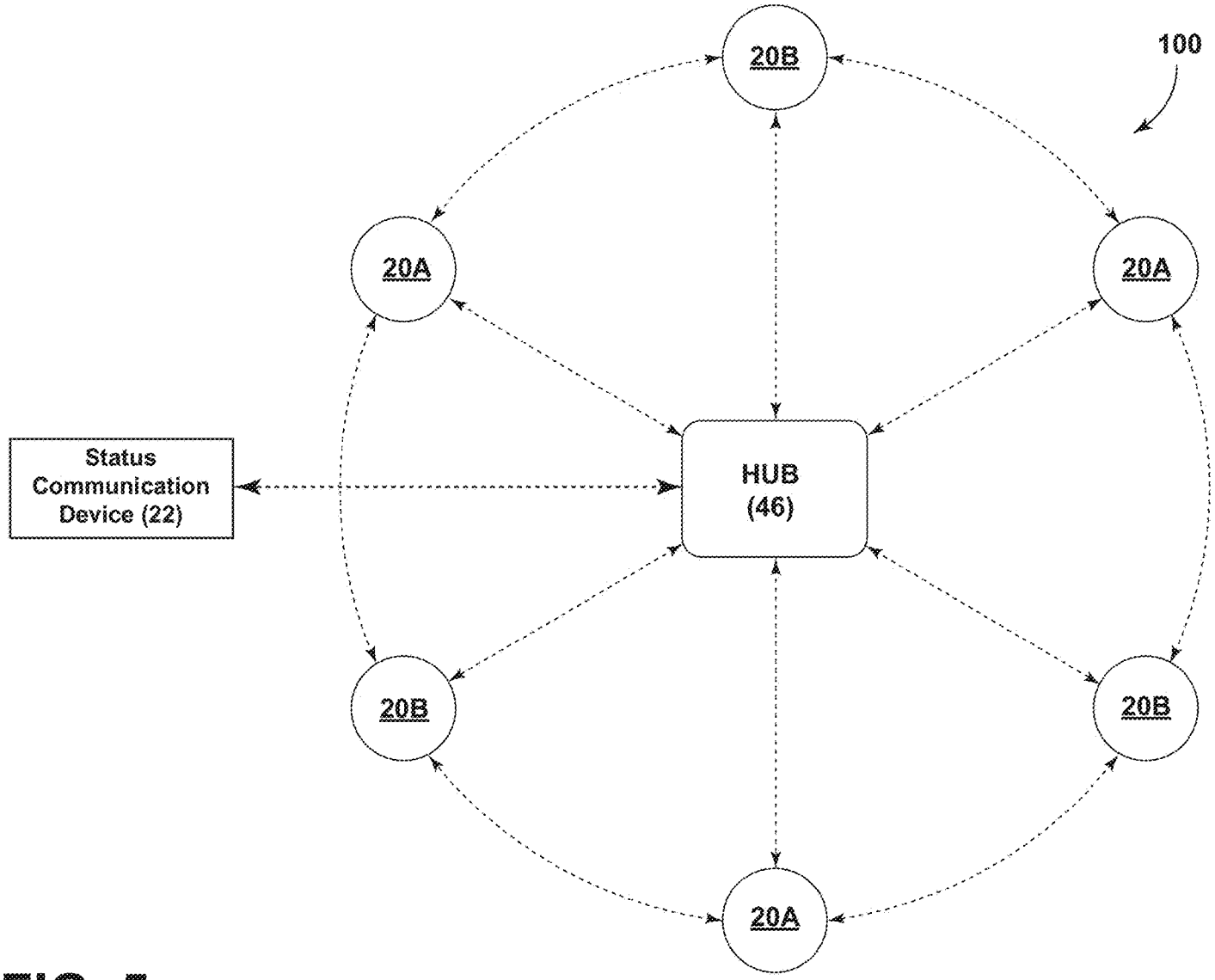
FIG. 5 is a schematic view of a network providing communication to a storage system, according to one aspect of the present disclosure.

Referring to initially to FIGS. 1-6, reference numeral 10 designates a storage system for a fuselage 12 of a plane 14. The storage system 10 includes at least one storage unit 16 defining an enclosed cargo storage space 18. At least one monitoring module 20A, 20B is disposed proximate the at least one storage unit 16. The at least one monitoring module 20A, 20B is configured to detect a condition within or proximate the at least one storage unit 16 that includes at least one of a temperature, a fire condition, a water leakage, a gas leakage, a chemical leakage, an explosive condition, or a movement of the at least one storage unit 16. At least one status communication device 22 is in communication with the at least one monitoring module 20A, 20B and is configured to alert a user of the detected condition by the monitoring module 20A, 20B (FIG. 5).

Figure 2:
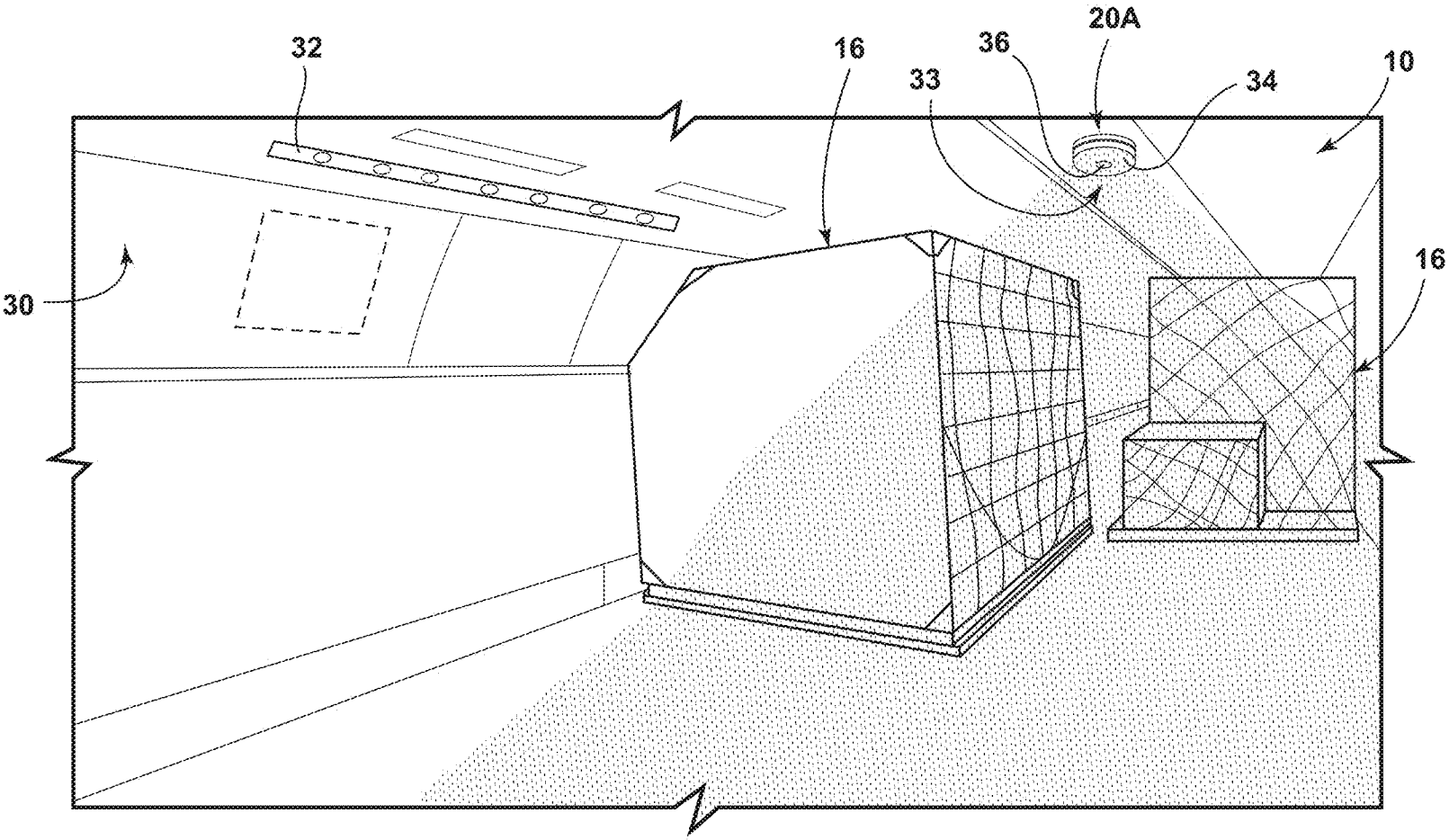
FIG. 2 is a side perspective view of a fuselage in a plane that contains a plurality of storage units, according to one aspect of the present disclosure.

With reference now to FIGS. 1 and 2, the fuselage 12 may contain the at least one storage unit 16. The plane 14 may be a cargo plane, a passenger plane, a passenger and cargo plane, or any other type of manned or unmanned aircraft where it may be beneficial to monitor the status of cargo in the at least one storage unit 16. The fuselage 12 may further include a cockpit 24, a first portion defining a passenger seating region 26, and a second portion defining a cargo region 28. The at least one storage unit 16 may be located in the cargo region 28 and the at least one status communication device 22 may be located in the cockpit 24. The at least one status communication device 22 may implement a variety of communication protocols. For example, the at least one status communication device 22 may be configured as a display with a traditional screen that generates visual alerts graphically and the display may further include an audible component that generates audible alerts to the user (e.g., a pilot or other individual). Further, the at least one status communication device 22 may implement other types of communication protocols in addition to or alternatively from the display, such as lights (e.g., flashing lights), speakers (e.g., audible alarms), combinations thereof, and/or the like. In some embodiments, the at least one status communication device 22 may include two or more status communication devices 22 that implement the same or different ones of the communication protocols. The communication protocol implemented in any given status communication device 22 may be based, at least in part, on the location of the status communication device 22.

The at least one status communication device 22 may be located in one or more regions of the fuselage 12 and/or in other locations not on the plane 14 in addition to or alternatively from the cockpit 24. For example, the at least one status communication device 22 may be located in a command center (e.g., aviation control building or center) of an airport in addition or alternatively to the cockpit 24. The at least one status communication device 22 may further be located in other regions of the fuselage 12, such as the storage unit 16 (e.g., on an internal or external surface of the storage unit 16) or other locations within the cargo region 28. In some implementations, the at least one status communication device 22 may be incorporated into the monitoring module 20A, 20B. In this manner, two or more status communication devices may be located in two or more of the command centers, the cockpit 24, the storage unit 16, the fuselage 12, and/or the cargo region 28. In some implementations, one of the status communication devices 22 is located in the cockpit 24 and/or the command center and implements the display and a different one of the status communication devices 22 is located in other locations of the fuselage 12 (e.g., the cargo region 28, integration in the monitoring module 20A, 20B, and/or the storage units 16) and implements a different one of the communication protocols, such as lights (e.g., flashing lights), speakers (e.g., audible alarms), combinations thereof, and/or the like.

With continued reference to FIGS. 1 and 2, the number of monitoring modules 20A, 20B and status communication devices 22 may be based, at least in part, on the number of storage units 16, the location of storage units 16, regulations related to the one or more conditions being monitored, and/or other factors. Generally speaking, the number of monitoring modules 20A, 20B may be selected to monitor each storage unit 16 contained within the plane 14 or select storage units 16 containing types of cargo that may be vulnerable to temperature, fire conditions, water leakages, gas leakages, chemical leakages, explosive conditions, or movement (e.g., shifting of the storage unit 16 and/or cargo contained within the storage unit 16).

With reference now to FIGS. 2 and 3, the cargo region 28 of the fuselage 12 defines a storage compartment 30 that may be large enough to contain a plurality of storage units 16. The at least one monitoring module 20A, 20B may include one or more external monitoring modules 20A (FIG. 2) and/or one or more internal monitoring module 20B (FIG. 3). The one or more external monitoring modules 20A may be located within the storage compartment 30 and/or otherwise outside the storage units 16 (e.g., on an external surface of the storage unit 16 or spaced from the storage unit 16). More particularly, the external monitoring modules 20A may be positioned to monitor more than one of the storage units 16, from a perspective external to the storage units 16. For example, the external monitoring modules 20A may be connected to one or more of the external surface of one or more of the storage units 16, a wall, ceiling, and/or a floor of the storage compartment 30. In this manner, a single one of the external monitoring modules 20A may be capable of detecting one or more of the conditions within one or more (e.g., two, three, four, or more) storage units 16. The internal monitoring modules 20B (FIG. 3), on the other hand, may be located within the storage units 16 and configured to directly monitor the cargo storage space 18. As depicted, the internal monitoring module 20B may be connected to an internal top edge of the storage units 16 where a ceiling and wall merge. The internal monitoring module 20B may also be connected to a wall, ceiling, or floor of the storage unit 16.

With continued reference to FIGS. 2 and 3, a condition suppression system 32 may be located in the storage compartment 30 that is in communication with the at least one monitoring modules 20A, 20B and/or the one or more status communication devices 22. The condition suppression system 32 is configured to suppress the detected condition, for example, via expelling a condition suppression agent and/or performing a different suppression action if one or more of the conditions is detected. As will be described in greater detail below, the condition suppression system 32 may be configured to automatically suppress the detected condition upon one or more of the conditions being detected, or manually via, for example, a user interfacing with the status communication devices 22, the monitoring modules 20A, 20B, and/or directly with the condition suppression system 32.

The condition suppression system 32 may be configured to expel fire suppression agents (e.g., in the event of a detected fire condition), open a ventilation port out of the plane 14 (e.g., in the event of a detected gas leakage or chemical leakage), generate a temperature-controlled air stream (e.g., in the event of a high or low temperature), and/or other types of agents for suppressing negative impacts from the detected conditions. The monitoring modules 20A, 20B may each be configured to detect a single one of the conditions. However, in other implementations, the monitoring modules 20A, 20B may each be configured to detect two or more of the conditions. For example, one of the monitoring modules 20A, 20B may be configured to detect two or more of the temperature, the fire condition, the water leakage, the gas leakage, the chemical leakage, the explosive condition, or the movement of the at least one storage unit 16. In addition, it should be appreciated that storage system 10 may include two or more monitoring modules 20A, 20B each configured to detect a different one of the temperature, the fire condition, the water leakage, the gas leakage, the chemical leakage, the explosive condition, or the movement of the at least one storage unit 16. In this manner, two or more monitoring modules 20A, 20B may be utilized to monitor different conditions within a single one of the storage units 16. In some embodiments, the condition suppression system 32 may be located, wholly or in part, in the storage unit 16 and work in conjunction with one of the monitoring modules 20A, 20B located within and/or external to the storage unit 16. In some implementations, a single one of the storage units 16 may wholly incorporate at least one of the monitoring modules 20A, 20B and the condition suppression system 32. In this manner, a storage units 16 out of a plurality of the storage units 16 can be selected based on the type of cargo and what conditions need to be monitored and suppressed.

With reference now to FIG. 4, the monitoring modules 20A, 20B may include an imaging system 33, for example, including a light source 34 and an image capturing device 36. More particularly, the light source 34 may generate light in visible and/or infrared ranges and the image capturing device 36 may be configured to capture images within the generated light spectrum. In some embodiments, imaging system 33 may be configured to extrapolate three-dimensional information ("3D"). For example, the light source 34 may be configured to generate light in a structured pattern such that images of the structured light may be extrapolated from two-dimensional ("2D") information into 3D information. However, it should be appreciated that the imaging system 33 may be configured to capture 2D and/or 3D information under other principles. For example, the imaging system 33 may include Light Detection and Ranging (Lidar) modules, multiple cameras operating under the principles of stereovision, Radio Detection and Ranging (RADAR) modules, ultrawide band location sensors, and/or the like. In this manner, the cargo contained in the storage unit 16 or the storage unit 16 itself can be monitored for movement to ensure appropriate handling and transport.

With continued reference to FIG. 4, in addition to or alternatively from the imaging system 33, the monitoring modules 20A, 20B may incorporate one or more sensors 37, the one or more sensors 37 may include, for example, thermal imaging devices or sensors, temperature sensors, gas analyzers, chemosensors, liquid sensors, humidity sensors, explosive trace detectors, motion sensors, pressure sensors, air quality monitors, and/or the like. In some embodiments, the storage units 16 may be assigned for a particular type of cargo based on what imaging system 33 or sensors 37 are incorporated into the monitoring modules 20A, 20B. More particularly, the storage units 16 may be constructed to contain a variety of cargo. For example, the cargo may be food, living cargo, or medicine that needs to be stored within a particular temperature, pressure, and air quality. The cargo may also include luggage, mailed packages, volatile substances, explosive substances, and other varieties that present possible fire conditions, water leakage conditions, gas leakage conditions, chemical leakage conditions, or explosive conditions.

With reference now to FIGS. 4 and 5, the at least one monitoring module 20A, 20B may transmit information wired or wirelessly to the one or more status communication device 22 via communication module 38 that is configured to transmit information. For example, if the monitoring module 20A, 20B is connected to the status communication device 22 in the wired connection, the communication module 38 may include an outlet port 40 for direct wired connection and communication to a control system in the plane 14 that communicates to the status communication device 22. The outlet port 40, for example, may extend through and/or be aligned with an aperture in the storage unit 16 if the internal monitoring module 20B is utilized. In addition to or alternatively from the outlet port 40, the communication module 38 may include a wireless transmitter 42 that sends signals wirelessly to the status communication device 22 (e.g., over long-range or short-range communications). The at least one monitoring module 20A, 20B may include a battery 44 that powers the components thereof. When the at least one monitoring module 20A, 20B utilizes the outlet port 40, the outlet port 40 may provide power to the components thereof. In some embodiments, the monitoring module 20A, 20B may include a location sensor 41 (e.g., ultrawide band) in addition to the sensors 37, such that the storage units 16 can be located within the cargo region 28. In this manner, if a condition is detected, the storage unit 16 can be quickly identified and located among, possibly, a plurality of the storage units 16.

As best depicted in FIG. 5, the communication module 38 may be capable of both transmitting and receiving information. More particularly, the monitoring modules 20A, 20B may be part of a network 100 in communication (e.g., wired or wireless) with each other or select monitoring modules 20A, 20B and the status communication device 22. In some implementations, the monitoring modules 20A, 20B may be in communication with a hub 46 that is in communication with the status communication device 22. In this manner, the network 100 may implement systems and methods for generating the alert to the user. For example, the alert may contain information (e.g., visually generated or illuminated with a light) on which specific storage unit 16 the condition is detected. In some examples, information transmitted between the monitoring modules 20A, 20B includes which conditions are being monitored. If the condition is detected in one of the monitoring modules 20A, 20B, other ones of the monitoring modules 20A, 20B in other storage units 16 that monitor the same conditions may be flagged (e.g., on the status communication device 22) as at risk of developing the same condition. For example, if poor air quality is detected in one storage unit 16, other nearby storage units 16 with cargo vulnerable to poor air quality can be communicated to the status communication device 22.

The monitoring modules 20A, 20B may have threshold metrics associated with the various conditions before the alert is generated. In this manner, if the condition is detected in one of the storage unit 16, nearby storage units 16 can be flagged and the metrics of the nearby storage units 16 can be closely monitored for potentially arising conditions, for example, air quality is lowering, temperature changes, and conditions which are in the early stages of arising but not at the threshold level. As such, preventative measures can be established via the condition suppression system 32. As another example, monitoring modules 20A, 20B in two separate storage units 16 that detected related, but not the same condition, may be in communication for flagging potential arising conditions. More particularly, one of the monitoring modules 20A, 20B may detect explosive conditions while another of the monitoring modules 20A, 20B may detect explosive conditions. In this manner, if a fire condition is detected it may function as a trigger whereby the alert or other information transmitted over the network 100 may include early application by the condition suppression system 32 in the storage unit 16 that is being monitored for the explosive condition. Other related triggering conditions may be based on, for example, one of the monitoring modules 20A, 20B may detect movement of one of the storage unit 16 that functions as a trigger to nearby storage containers where gas leakage, chemical leakage, and/or explosive conditions are being monitored.

Figure 6:
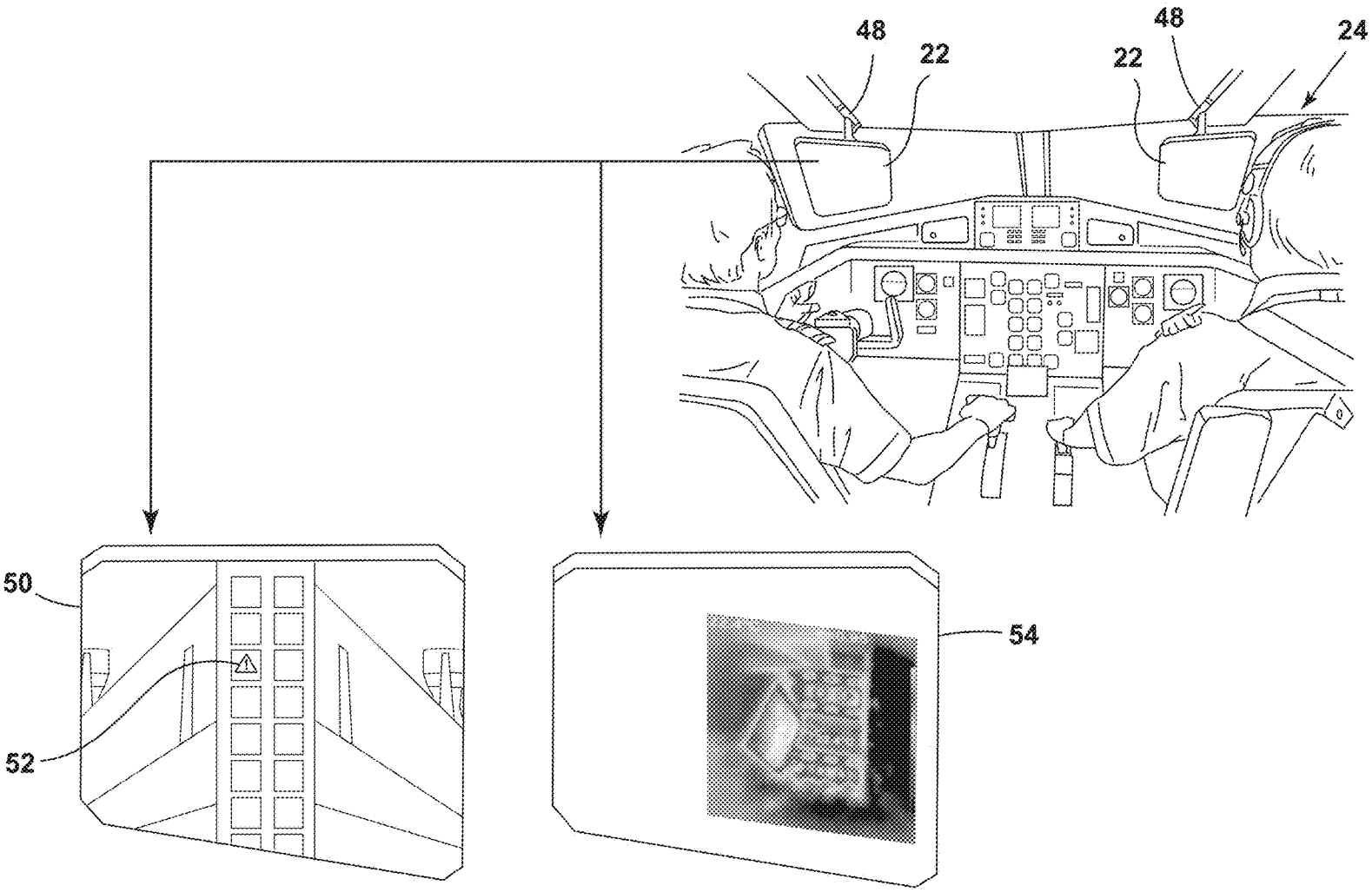
FIG. 6 is an interior view of a cockpit including At least one status communication device that notifies a user of a detected condition in a storage container, according to one aspect of the present disclosure.

With reference now to FIG. 6, an interior of the cockpit 24 is depicted as including the status communication device 22. The status communication device 22 may be located on or otherwise integrated within a visor 48 that is moveable between a stowed position where the status communication device 22 is positioned away from the pilot's view and an active position (e.g., as illustrated) where the status communication device 22 is fully visible. The status communication device 22 (e.g., via the visor 48) may also be moveable between one of several active positions within the cockpit 24. The status communication device 22 is configured to receive detected conditions within the network 100 (e.g., from the monitoring module 20A, 20B or hub 46) and generate a notification to the user. In some embodiments, the status communication device 22 may be dimmable and switch between levels of transmissiveness. In this manner, the status communication device 22 may be partially transparent. In other embodiments, the status communication device 22 may be located in a headset worn by a pilot or other personnel. The headset may be configured to operate under the principles of mixed reality. The user may be a pilot or other on board or off board staff with flight safety responsibilities. In still other embodiments, the status communication device 22 may be incorporated into an instrumentation panel or a window of the airplane 14. The status communication device 22 may generate messages and/or images of the storage compartment 30. The images of the storage compartment 30 may include overview images 50 that have schematic graphics, real images that are graphically generated (e.g., from one or more external monitoring modules 20A, 2B), combinations thereof, and/or other types of visual information that conveys a status of each of the storage units 16 in the storage compartment 30. If a condition is detected in one of the storage units 16, the alert may include a graphical warning 52 that may be overlayed on the overview images 50 designating which storage unit 16 has the detected condition, and where that storage unit 16 is located in the cargo region 28. The graphical warning 52 may further include storage units 16 that may be vulnerable to the detected condition as described above.

With continued reference to FIG. 5, the graphical warning 52 may be visually different depending on the type of detected condition or potentially arising conditions that have been flagged as associated with the detected condition in a nearby or related storage unit 16. For example, the graphical warning may be a water drop in the event of detected water leakage or a fire in the event of a detected fire. The images of the storage compartment 30 may include unit specific images 54 (e.g., from one or more internal monitoring modules 20B) that have information relating to conditions within a single storage unit 16. For example, the unit specific images 54 may include thermal images, images within the visible spectrum, and/or the like. In some embodiments, the status communication device 22 may be interactive (e.g., such as a touch screen or a separate user interface). The status communication device 22 may be configured, based on input from the user, to select one out of the plurality of storage units 16 in the overview image 50 to switch to the unit specific image 54 to obtain more information. In addition to images, the status communication device 22 may also include specific information from the monitoring modules 20A, 20B including information related to quantifying the condition, such as air quality metrics, the current temperature, the current humidity, a type of a gas or chemical, or a quantity of a gas or chemical.

The disclosure herein is further summarized in the following paragraphs and is further characterized by combinations of any and all of the various aspects described therein.

According to one aspect of the present disclosure, a storage system for a plane fuselage including at least one storage unit defining an enclosed cargo storage space. At least one monitoring module is disposed proximate the at least one storage unit. The at least one monitoring module is configured to detect a condition within or proximate the at least one storage unit that includes at least one of a temperature, a fire condition, a water leakage, a gas leakage, a chemical leakage, an explosive condition, or a movement of the at least one storage unit. At least one status communication device is in communication with the at least one monitoring module and is configured to alert a user of the detected condition by the at least one monitoring module.

According to another aspect, an at least one monitoring module includes two or more monitoring modules that, together, are configured to detect two or more of a temperature, a fire condition, a water leakage, a gas leakage, a chemical leakage, an explosive condition, or a movement of at least one storage unit.

According to yet another aspect, an at least one monitoring module is located in an at least one storage unit.

According to another aspect, an at least one storage unit includes a plurality of storage units.

According to yet another aspect, an at least one monitoring module includes a single monitoring module that monitors more than one of a plurality of storage units.

According to still yet another aspect, an at least one monitoring module includes a plurality of monitoring modules, each of the plurality of monitoring modules configured to monitor a different one of a plurality of storage units.

According to another aspect, an at least one monitoring module includes a thermal camera.

According to yet another aspect, at least one monitoring module includes a camera that is configured to capture images within at least one storage unit.

According to still yet another aspect, at least one monitoring module includes a light source configured to illuminate an interior of the at least one storage unit.

According to another aspect, at least one monitoring module includes a plurality of monitoring modules each in communication with the at least one status communication device.

According to yet another aspect, a storage system includes a plurality of storage units, and if a condition is detected in one of the storage units, a different storage unit is flagged by at least one status communication device for a potentially arising condition.

According to still yet another aspect, at least one status communication device includes a display with an overview image of a plurality of storage units and a different storage unit is flagged by a graphical warning over the different storage unit depicted in the overview image.

According to still yet another aspect, a different storage unit is flagged based on contents within the different storage unit that are potentially vulnerable to a detected condition.

According to another aspect of the present disclosure, a storage system for monitoring a plurality of storage units in a plane fuselage includes at least one monitoring module. The at least one storage module is configured to be disposed proximate the plurality of storage units. The at least one monitoring module is further configured to detect a condition in at least one of the plurality of storage units that includes at least two of a temperature, a fire condition, a water leakage, a gas leakage, a chemical leakage, or an explosive condition. At least one status communication device is in communication with the at least one monitoring module. The status communication device is configured to alert a user of the detected condition by the at least one monitoring module.

According to another aspect, a suppression system is configured to be located in a fuselage, the suppression system is in communication with at least one monitoring module and to suppress the detected condition.

According to yet another aspect, a suppression system includes a fire suppression system, the fire suppression system configured to expel a fire suppression agent automatically upon a fire condition being detected.

According to still yet another aspect, at least one monitoring module includes a plurality of monitoring modules each in communication with at least one status communication device, and, if a fire condition is detected in one of a plurality of storage units, a different storage unit is flagged based on contents within the different storage unit that are potentially vulnerable to the fire condition.

According to another aspect, at least one status communication device includes a visor incorporating a display that is configured to be connected to a cockpit of the plane.

According to yet another aspect of the present disclosure, a storage system for a plane fuselage includes a plurality of monitoring modules configured to be assigned to a plurality of storage units based on contents in the plurality of storage units. The plurality of monitoring modules are configured to detect a condition that includes at least one of a temperature, a fire condition, a water leakage, a gas leakage, a chemical leakage, an explosive condition, or a movement. At least one status communication device is in communication with the plurality of monitoring modules and is configured to alert a user of the detected condition by the plurality of monitoring module via an overview image that designates which of the plurality of storage units is associated with the detected condition.

According to another aspect, a storage unit different than a designated storage unit is flagged in an overview image for a potentially arising condition based on its contents.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connectors or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A storage system for a plane fuselage, comprising:

a plurality of storage units defining an enclosed cargo storage space;

at least one monitoring module disposed proximate to at least one storage unit of the plurality of storage units, the at least one monitoring module configured to detect a condition within or proximate the at least one storage unit that includes at least one of a temperature, a fire condition, a water leakage, a gas leakage, a chemical leakage, or an explosive condition;

an imaging system configured to extract three-dimensional information on the position and movement of the at least one storage unit; and at least one status communication device in communication with the at least one monitoring module and the at least one imaging system and configured to alert a user of the detected condition by the at least one monitoring module;

wherein the at least one monitoring module further includes a plurality of monitoring modules each in communication with the at least one status communication device;

wherein if the condition is detected in one of the plurality of storage units, a different storage unit is flagged by the at least one status communication device for a potentially arising condition; and wherein the at least one status communication device includes a display with an overview image of the plurality of storage units and the different storage unit is flagged by overlaying a graphical warning over the different storage unit depicted in the overview image, the graphical warning configured to be different based on a type of the detected condition.

2. The storage system of claim 1, wherein the at least one monitoring module includes two or more monitoring modules that, together, are configured to detect two or more of the temperature, the fire condition, the water leakage, the gas leakage, the chemical leakage, or the explosive condition.

3. The storage system of claim 1, wherein the at least one monitoring module is located in the at least one storage unit and configured to be in wired communication with the at least one status communication device through a port in the at least one storage unit.

4. The storage system of claim 1, wherein the at least one monitoring module includes a single monitoring module external to the plurality of storage units that simultaneously monitors more than one of the plurality of storage units.

5. The storage system of claim 1, wherein the at least one monitoring module includes a plurality of monitoring modules, each of the plurality of monitoring modules configured to monitor a different one of the plurality of storage units.

6. The storage system of claim 1, wherein the at least one monitoring module includes a thermal camera.

7. The storage system of claim 1, wherein the at least one monitoring module includes a camera that is configured to capture images within the at least one storage unit, the camera in operable communication with the at least one status communication device and the at least one status communication device configured to generate the captured images.

8. The storage system of claim 7, wherein the at least one monitoring module includes a light source configured to illuminate an interior of the at least one storage unit.

9. The storage system of claim 1, wherein the different storage unit is flagged based on contents within the different storage unit that are potentially vulnerable to the detected condition.

10. A storage system for monitoring a plurality of storage units in a plane fuselage, the storage system comprising:

a location sensor in each of the plurality of storage units;

at least one monitoring module configured to be disposed proximate the plurality of storage units, the at least one monitoring module configured to detect a condition in at least one of the plurality of storage units that includes at least two of a temperature, a fire condition, a water leakage, a gas leakage, a chemical leakage, or an explosive condition; and at least one status communication device that is in communication with the at least one monitoring module and configured to identify which of the plurality storage units is associated with the detected condition based on feedback from the location sensor to alert a user of the detected condition by the at least one monitoring module;

wherein the at least one monitoring module further includes a plurality of monitoring modules each in communication with the at least one status communication device;

wherein if the condition is detected in one of the plurality of storage units, a different storage unit is flagged by the at least one status communication device for a potentially arising condition; and wherein the at least one status communication device includes a display with an overview image of the plurality of storage units and the different storage unit is flagged by overlaying a graphical warning over the different storage unit depicted in the overview image, the graphical warning configured to be different based on a type of the detected condition.

11. The storage system of claim 10, further including a suppression system configured to be located in the fuselage, the suppression system is in communication with the at least one monitoring module and configured to suppress the detected condition.

12. The storage system of claim 11, wherein the suppression system is configured to perform two or more different actions based, at least in part, on a type of the detected condition and contents of neighboring storage units.

13. The storage system of claim 10, wherein the at least one status communication device includes a visor incorporating a display that is configured to be connected to a cockpit of a plane.

14. A storage system for a plane fuselage, comprising:

a plurality of monitoring modules configured to be assigned to a plurality of storage units based on contents in the plurality of storage units, the plurality of monitoring modules configured to detect a condition that includes at least one of a temperature, a fire condition, a water leakage, a gas leakage, a chemical leakage, an explosive condition, or a movement;

at least one status communication device in communication with the plurality of monitoring modules and configured to alert a user of the detected condition by the plurality of monitoring module via an overview image that graphically generates graphical warnings overlaid on which of the plurality of storage units is associated with the detected condition; and wherein a different graphical warning is overlaid on a storage unit different than the designated storage unit is flagged in the overview image for a potentially arising condition based on the contents.

* * * * *